US006888056B2

(12) United States Patent
Leonard

(10) Patent No.: US 6,888,056 B2
(45) Date of Patent: May 3, 2005

(54) PIANO STRING COIL LIFTING AND SETTING APPARATUS

(76) Inventor: Brant Leonard, 1369 Birmley, Traverse City, MI (US) 49686

( * ) Notice: Subject to any disclaimer, the term of this patent is extended or adjusted under 35 U.S.C. 154(b) by 360 days.

(21) Appl. No.: 10/271,470

(22) Filed: Oct. 16, 2002

(65) Prior Publication Data

US 2004/0074374 A1 Apr. 22, 2004

(51) Int. Cl.[7] ..... G10G 7/00

(52) U.S. Cl. ..... 84/458; 84/459; 84/453; 84/454; 84/200

(58) Field of Search ..... 84/458, 459, 453, 84/454, 200

(56) References Cited

U.S. PATENT DOCUMENTS

| | | | | | |
|---|---|---|---|---|---|
| 310,674 | A | | 1/1885 | Hale | |
| 550,366 | A | | 11/1895 | Felldin | |
| 680,926 | A | * | 8/1901 | Klinder | 84/459 |
| 820,418 | A | * | 5/1906 | Hindman | 84/459 |
| 921,203 | A | | 5/1909 | Conover | |
| 1,232,862 | A | | 7/1917 | Severy et al. | |
| 3,412,638 | A | | 11/1968 | Pease | |
| 4,276,805 | A | | 7/1981 | Kaneko | |
| 5,736,660 | A | * | 4/1998 | Frankel | 84/200 |

* cited by examiner

*Primary Examiner*—Shih-yung Hsieh
(74) *Attorney, Agent, or Firm*—Artz & Artz, P.C.

(57) ABSTRACT

An apparatus (10) for lifting and setting a piano string coil (16) is provided for improving tuning stability. Preferably, the apparatus (10) includes an internal slide hammer portion (12) and a string engaging portion (14) extending from the internal slide hammer portion (12). The string engaging portion (14) is intended to engage a piano string coil (16) wrapped around a tuning pin (18) and transmit an upward or downward force from the internal slide hammer portion (12) to the piano string coil (16).

20 Claims, 5 Drawing Sheets

PIANO STRING COIL LIFTING AND SETTING APPARATUS

TECHNICAL FIELD

The present invention relates generally to tuning tools for pianos, and more particularly to a piano string coil lifting and setting apparatus.

BACKGROUND OF THE INVENTION

Tuning is widely known as a significant type of piano maintenance because it allows the piano to retain a proper pitch, e.g. A-440. A piano typically requires tuning in two common situations. First, newly manufactured pianos typically require extensive tuning during their first few years. During this period, the new strings typically stretch and the wooden components usually settle thereby lowering the pitch of the piano beyond a desired range. In view of these circumstances, piano manufacturers typically recommend that newly manufactured pianos be tuned three to four times during the first year alone.

In addition, seasonal changes are a second condition known for causing pianos to lose their desired pitch. More specifically, the disparity in humidity levels from one season to the next can have a significant effect on the soundboard. As is known in the art, the soundboard is a large piece of wood placed near the strings inside the piano. When the strings are struck by hammers and caused to vibrate, the soundboard resonates in accordance with the vibration of the strings. In this regard, the soundboard amplifies the vibration to a volume level that can be heard. As the humidity level rises, the soundboard typically swells thereby increasing its crowned shape and stretching the strings to a higher pitch. On the other hand, in dry conditions, the soundboard contracts thereby lowering tension in the strings and causing the pitch to drop. As a result, piano manufacturers typically recommend at least two tunings per year to correspond with the change of seasons.

One skilled in the art understands that tuning a piano typically requires increasing or decreasing the tension in the strings. This adjustment is typically accomplished by coiling the piano strings around the tuning pins at the desired tension level.

Unfortunately, this process can cause the strings to improperly engage the tuning pins thereby causing tuning instability. Specifically, the string may be coiled around the tuning pin across a substantial length of the tuning pin's longitudinal axis. Consequently, less friction may exist between the string and the tuning pin, which allows the string to slip on the tuning pin and decreases tension in the string, as well as the associated pitch. In this respect, the piano may require tuning earlier or more frequently than it should.

One proposed solution for tuning instability employs string lifters. Existing string lifters are used to pack the piano string into a tighter, more condensed coil around the tuning pin. With this proposed solution, the need for tuning is typically limited to the two common situations mentioned above.

One drawback of these string lifters is that their structure requires a user to manipulate the lifters around other components of the piano. In particular, the structure of existing lifters typically requires a user to manipulate the handle within a horizontal plane substantially close to the strings and the pin block. As a result, the user is ordinarily required to practice special care in avoiding these components for the purpose of merely operating the lifter, as well as preventing injury to his hand or damage to the strings or the pin block.

In addition, the handle is configured such that it is in a position that prevents the user from seeing the coil as he is operating the lifter. In this regard, the user typically cannot see how much he is adjusting the coil while he is operating the lifter. Instead, the user ordinarily relies upon feel to estimate the degree of his adjustments. Therefore, these structural limitations of existing lifters make tuning of pianos somewhat cumbersome.

Another drawback of these string lifters is that they comprise an integral rigid construction that can require the user to apply substantial force in order to move the piano string along the tuning pin. If the string becomes suddenly dislodged from its position, the user's arm and the string lifter may be accidentally thrusted in a manner that causes harm to the user or damage to the piano.

Therefore, it would be advantageous to provide a piano string coil lifting and setting apparatus that allows a user to accurately and easily pack a string coiled around a tuning pin.

SUMMARY OF THE INVENTION

It is therefore an object of the present invention to provide a piano string coil lifting and setting apparatus that permits the user to easily adjust the coil on the tuning pin with minimal risk of injury to the user or damage to the piano.

It is yet another object of the present invention to provide a piano string coil lifting and setting apparatus that permits a user to readily see the coil as he is adjusting it on the tuning pin.

It is still another object of the present invention to provide a piano string coil lifting and setting apparatus that allows a user to apply minimal effort in adjusting the coil without risking injury to the user or damage to the piano.

In accordance with the above and the other objects of the present invention, an apparatus for lifting and setting piano string coils is provided for enabling tuning stability in a piano string coil that is wrapped around a tuning pin. The apparatus includes a slide hammer portion and a string engaging portion extending from the slide hammer portion. The string engaging portion is intended to engage a piano string coil wrapped around a tuning pin and transmit a force from the slide hammer portion to the piano string coil.

One advantage of the present invention is that a user may easily adjust a piano string coil on a tuning pin with minimal risk of harm to the user or damage to the piano.

Another advantage of the present invention is that a user may visually see the piano string coil as it is being adjusted thereby allowing for quicker and more accurate adjustments.

Yet another advantage of the present invention is that a user may utilize a slide hammer portion for applying smaller, more controllable forces in adjusting the piano string coil on the tuning pin.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE PREFERRED EMBODIMENT

Figure 1A:
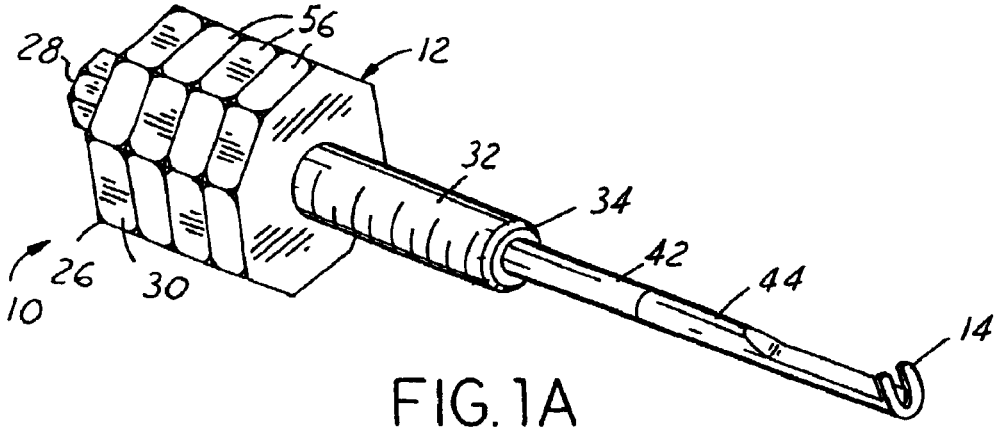
FIG. 1A is a perspective view of a piano string coil lifting and setting apparatus, in accordance with a preferred embodiment of the present invention.

In the following figures, the same reference numerals are used to identify the same components in the various views.

Figure 1B:
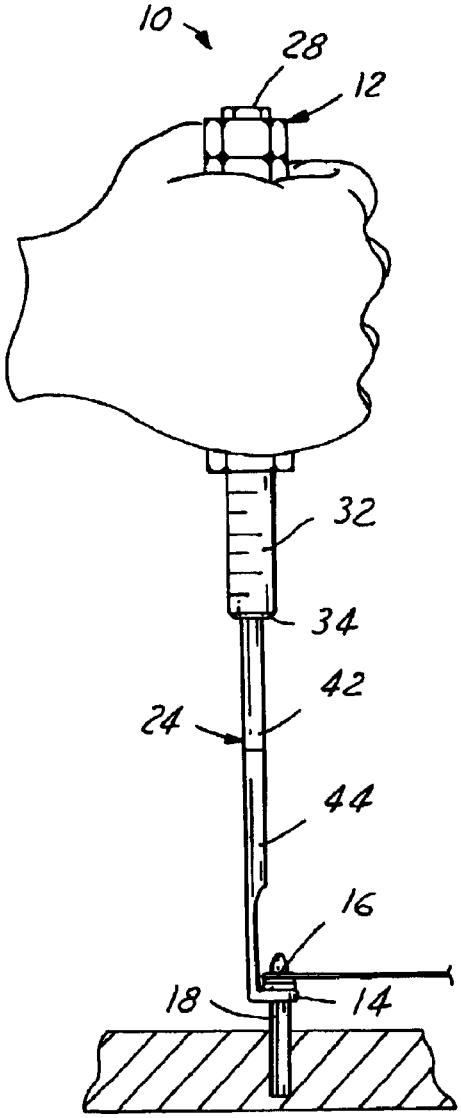
FIG. 1B is a side view of a piano string coil lifting and setting apparatus as utilized for applying an upward force on a piano string coil, in accordance with a preferred embodiment of the present invention.
Figure 1C:
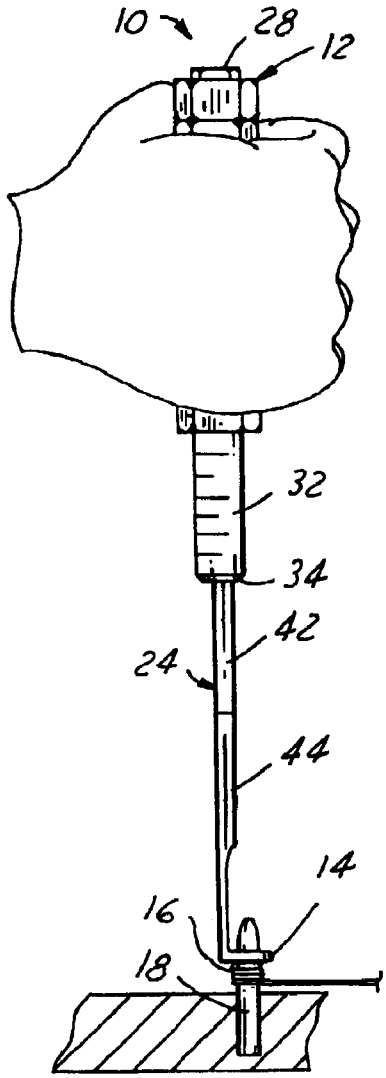
FIG. 1C is a side view of a piano string coil lifting and setting apparatus as utilized for applying an downward force on a piano string coil, in accordance with a preferred embodiment of the present invention.

Referring now primarily to FIGS. 1A through 1C, a piano string coil lifting and setting apparatus 10 ("apparatus"), in accordance with a preferred embodiment of the present invention, is shown. In general, the apparatus 10 includes an internal slide hammer portion 12 and a string engaging portion 14 extending from the internal slide hammer portion 12. The string engaging portion 14 is intended to engage a piano string coil 16, which is wrapped around a tuning pin 18 for the purpose of adjusting the coil 16 to a desired position on the tuning pin 18. For example, the string engaging portion 14 is preferably intended to apply either an upward force or a downward force to the coil 16 so as to pack the coil 16 within a smaller longitudinal section of the tuning pin 18. Also, the internal slide hammer portion 12 is generally configured to allow a user to grasp the apparatus 10 with his hand and apply the upward or downward force.

Figure 1D:
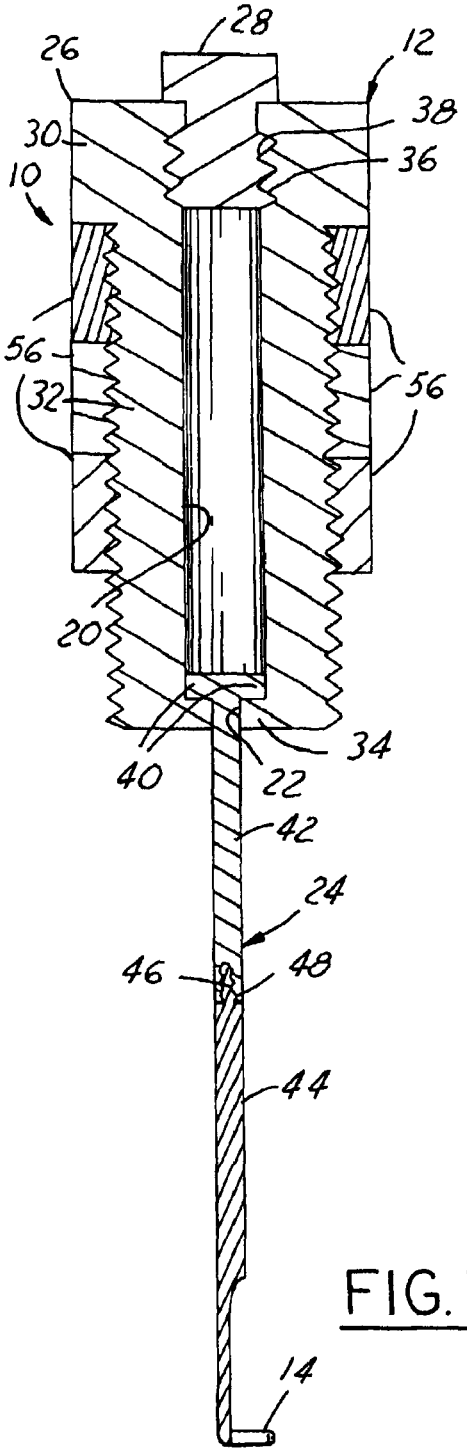
FIG. 1D is a cross-sectional view of a piano string coil lifting and setting apparatus configured to apply an upward force on a piano string coil, in accordance with a preferred embodiment of the present invention.
Figure 1E:
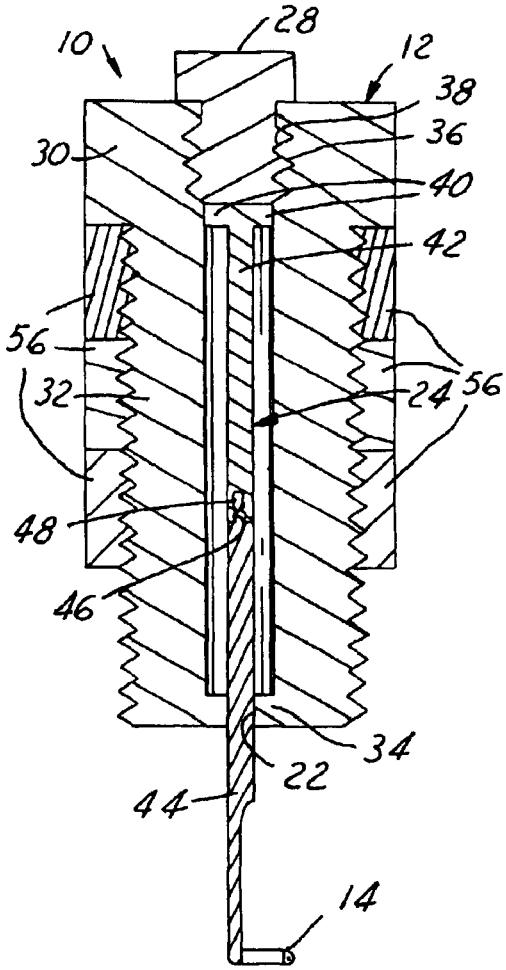
FIG. 1E is a cross-sectional view of a piano string coil lifting and setting apparatus configured to apply a downward force on a piano string coil, in accordance with a preferred embodiment of the present invention.

More specifically, as best shown in FIGS. 1D and 1E, the internal slide hammer portion 12 preferably includes a housing with a bore 20 integrally formed therein, a hole 22 situated near an end portion of the bore 20, and a rod 24 that is slidable into and out of the bore 20 and through the hole 22.

The housing preferably includes a main bolt member 26 and a retaining bolt member 28, both utilized for defining the bore 20. The main bolt member 26 has a head portion 30 and a shaft portion 32. Preferably, the head portion 30 and a substantial length of the shaft portion 32 define a longitudinal section of the bore 20.

Moreover, the retaining bolt member 28 and a bottom section 34 of the shaft portion 32 preferably define the opposing ends of the bore 20. In particular, one end of the bore 20 preferably is defined by engaging the retaining bolt member 28 to the head portion 30 of the main bolt member 26. This engagement may be accomplished by fastening an external threaded fastener 36 integrated on the retaining bolt member 28 to an internal threaded fastener 38 integrated on the main bolt member 26 within the bore 20. However, it is understood that the retaining bolt member 28 may be attached to the main bolt member 26 by utilizing a variety of other suitable fasteners.

Furthermore, an opposite end of the bore 20 is defined by the bottom section 34 of the shaft portion 32. This bottom section 34 has the hole 22 integrally formed therein adjacent to the bore 20.

The hole 22 is preferably sized smaller than the bore 20 for the purpose of retaining the rod 24 within the bore 20. In particular, the rod 24 has a flange 40 extending therefrom that is sized slightly smaller than the bore 20 and larger than the hole 22. In this regard, the flange 40 is free to travel back and forth between the retaining bolt member 28 and the bottom section 34 of the shaft portion 32.

In the preferred embodiment, the rod 24 is characterized by an anchor shank 42 and a tool shank 44 for attachment to the anchor shank 42. Preferably, the anchor shank 42 has the flange 40 integrally attached thereon and reciprocates within the bore 20. The anchor shank 42 preferably has an internal threaded shank fastener 46 integrated within an end for connection to an external threaded shank fastener 48 integrated on an end of the tool shank 44.

Figure 3A:
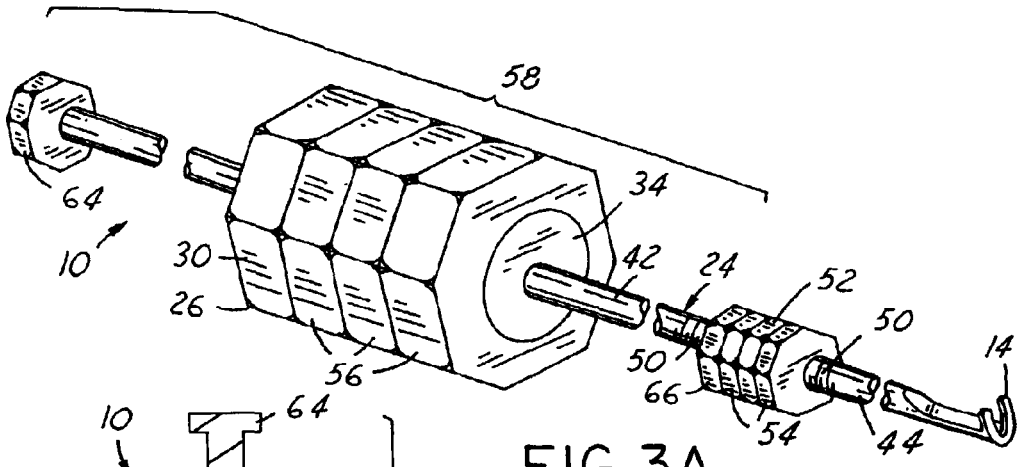
FIG. 3A is a perspective view of a piano string coil lifting and setting apparatus that includes an external slide hammer portion, in accordance with an alternative embodiment of the present invention.
Figure 3C:
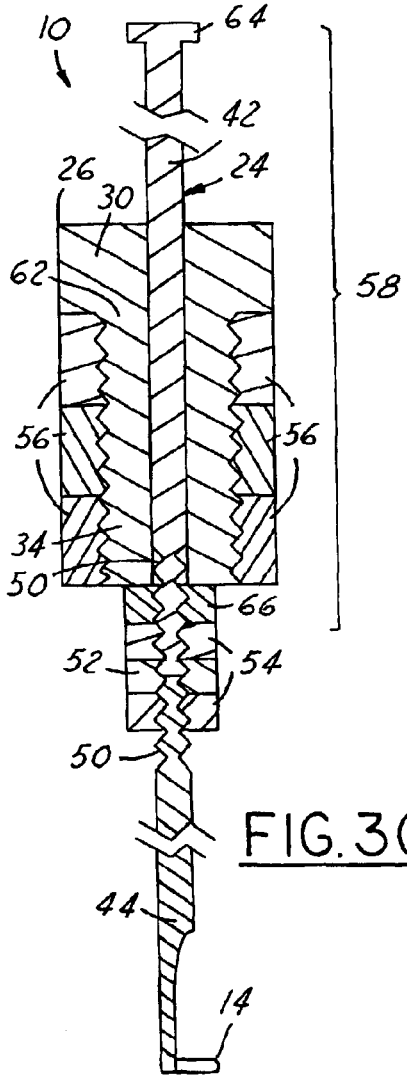
FIG. 3C is a cross-sectional view of a piano string coil lifting and setting apparatus configured to apply a downward force on a piano string coil, in accordance with an alternative embodiment of the present invention.
Figure 3B:
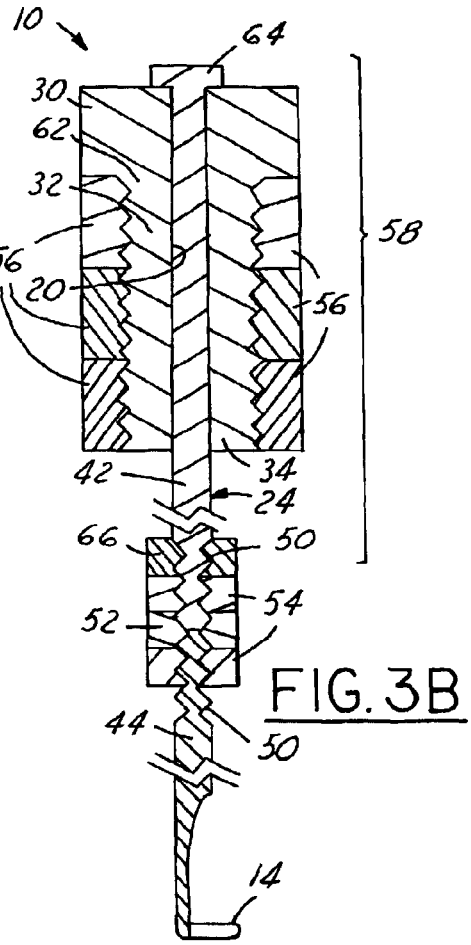
FIG. 3B is a cross-sectional view of a piano string coil lifting and setting apparatus configured to apply an upward force on a piano string coil, in accordance with an alternative embodiment of the present invention.

Of course, the attachment between the shanks 42, 44 may be accomplished by a variety of other suitable fasteners. For example, as shown in FIGS. 3A, 3B, and 3C, the anchor shank 42 and the tool shank 44 may both have ends with external threaded fasteners 50 integrated thereon. Alternatively, the tool shank 44 and the anchor shank 42 may be formed as a single integral piece.

With reference to the shanks 42, 44 illustrated in FIGS. 3B and 3C, the external threaded fasteners 50 may be coupled together by a conventional nut fastener member 52 bridged between the two external threaded fasteners 50. Furthermore, each external threaded fastener 50 may have one or more securing nut fasteners 54 secured thereto and adjacent to one side of the conventional nut fastener member 52. These securing nut fastener members 54 are intended to hold the conventional nut fastener member 52 in place between the tool shank 44 and the anchor shank 42.

Referring back to FIGS. 1D and 1E, the tool shank 44 preferably has the string engaging portion 14 secured to and extending therefrom. The string engaging portion 14 preferably comprises two prongs extending substantially perpendicularly from the tool shank 44. These prongs are intended to contact a piano string coil 16 wrapped around a tuning pin 18 for the purpose of applying an upward or downward force on the coil 16.

In operation, as best shown in FIGS. 1B and 1D, a user may pack the coil 16 in an upward direction by contacting the string engaging portion 14 to a lower end of the coil 16 and then pulling the internal slide hammer portion 12 upward and away from the coil 16. In doing so, the main bolt member 26 may slide up the rod 24 and the bottom section 34 of the shaft portion 32 may contact the flange 40 thereby applying an upward force through the rod 24 and the string engaging portion 14 to the coil 16. The user may repeatedly slide the internal slide hammer portion 12 up and down so as to strike the bottom section 34 of the main bolt member 26 against the flange 40 and incrementally nudge the coil 16 upward. In this regard, the bottom section 34 is an upward housing detent and the flange 40 is an upward rod detent for engaging the upward housing detent and applying the upward force to the coil 16.

Moreover, as best shown in FIGS. 1C and 1E, a user may pack the coil 16 in a downward direction by placing the string engaging portion 14 in communication with an upper end of the coil 16 and then subsequently pushing the internal slide hammer portion 12 downward and toward the coil 16. In doing so, the main bolt member 26 may slide down the rod 24 and the retaining bolt member 28 may contact the flange 40 thereby applying a downward force through the rod 24 and the string engaging portion 14 to the coil 16. The user may repeatedly slide the internal slide hammer portion 12 up and down so as to strike the retaining bolt member 28 against the flange 40 and incrementally nudge the coil 16 downward. In this respect, the retaining bolt member 28 is a downward housing detent and the flange 40 is a downward rod detent for engaging the downward housing detent and applying the downward force to the coil 16.

One skilled in the art will understand that the internal slide hammer portion 12 allows a user to apply smaller, more controllable forces to adjust the coil 16 on the pin 18. In addition, the structure of the apparatus 10 permits the user to view the coil 16 as he is adjusting it on the pin.

The shaft portion 32 of the main bolt member 26 preferably includes one or more weight members 56 attached thereon for increasing the mass of the internal slide hammer portion 12 and consequently increasing the force that can be applied to the coil 16. As a person skilled in the art will understand, increasing the mass of the slide hammer portion 12 can increase the force applied to the flange 40 as it is struck by either the bottom section 34 of the shaft portion 32 or the retaining bolt member 28. In this regard, the increased force is transmitted through the rod 24 and the string engaging portion 14 to the coil 16.

Preferably, the weight members 56 are one or more conventional nut members threadably fastened to the shaft portion 32. However, it is understood that washers and various other structures may be employed to increase the mass of the internal slide hammer portion 12.

Although the above description provides a detailed account of the preferred embodiment of the present invention, it is understood that the invention may include various other suitable alternative configurations.

Figure 2A:
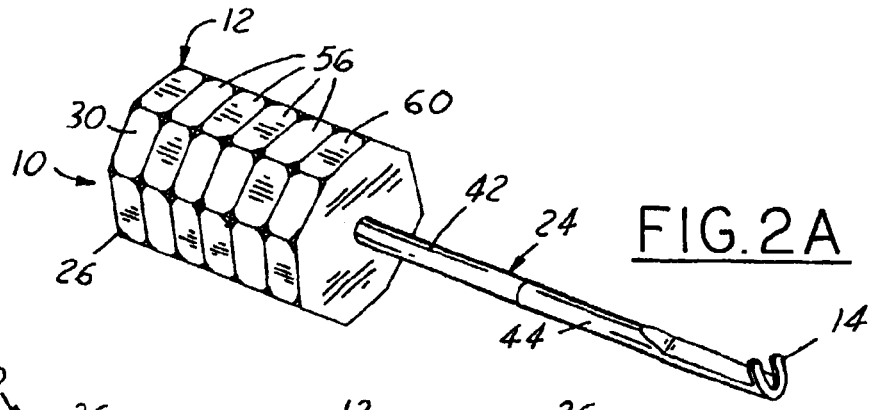
FIG. 2A is a perspective view of a piano string coil lifting and setting apparatus, in accordance with an alternative embodiment of the present invention.
Figure 2B:
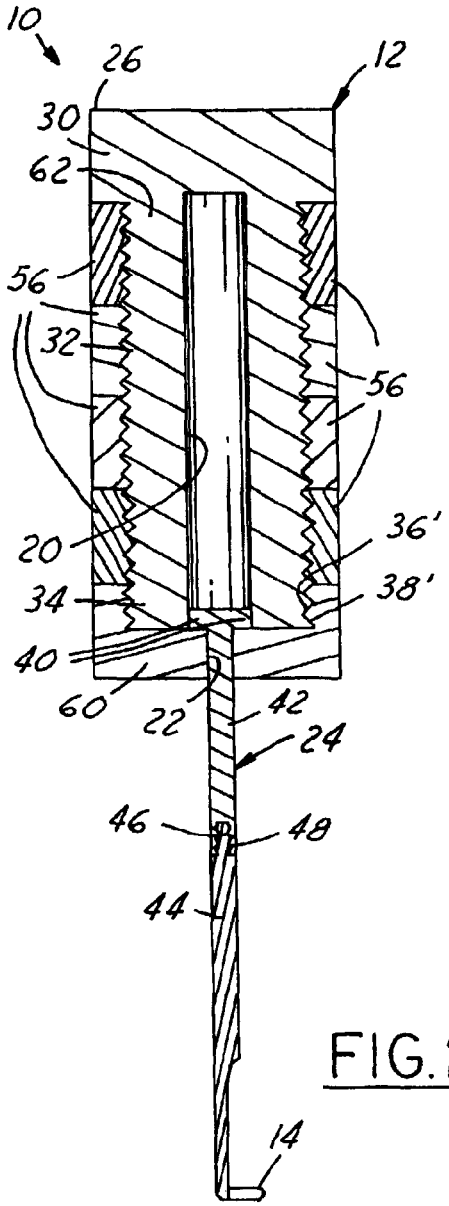
FIG. 2B is a cross-sectional view of a piano string coil lifting and setting apparatus configured to apply an upward force on a piano string coil, in accordance with an alternative embodiment of the present invention.
Figure 2C:
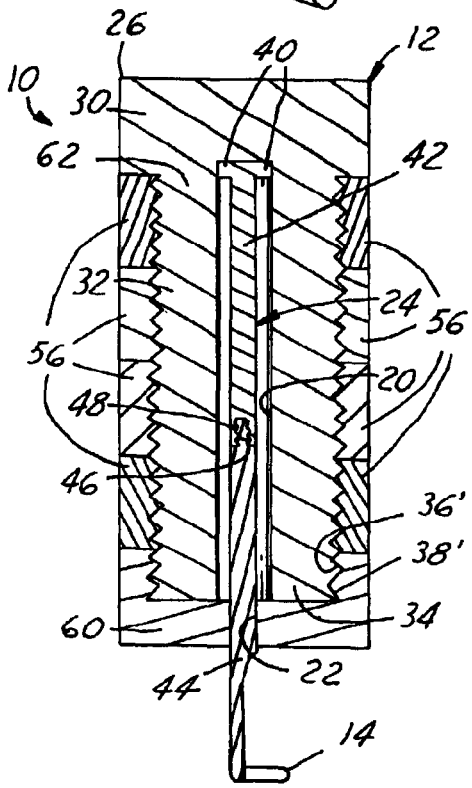
FIG. 2C is a cross-sectional view of a piano string coil lifting and setting apparatus configured to apply a downward force on a piano string coil, in accordance with an alternative embodiment of the present invention.

For example, as shown in FIGS. 2A through 2C, an alternative embodiment may accomplish a structure that is similar to the preferred embodiment. In particular, similar to the preferred embodiment, the apparatus 10 may include an internal slide hammer portion 12 and a string engaging portion 14 extending from the internal slide hammer portion 12. In contrast to the preferred embodiment, the internal slide hammer portion 12 may include a main bolt member 26 and a retaining nut member 60, both employed for defining a bore 20. The main bolt member 26 has a head portion 30 and a shaft portion 32. The bore 20 preferably has a longitudinal section that is defined by a substantial length of the shaft portion 32. Unlike the previous preferred embodiment, in this embodiment, the head portion 30 does not comprise an open end of the bore 20.

Opposing ends of the bore 20 may be defined by the retaining nut member 60 and a top section 62 of the shaft portion 32. In particular, one end of the bore 20 may be defined by either the head portion 30 of the main bolt member 26 or the top section 62 of the shaft portion 32.

An opposing end of the bore 20 preferably is defined by engaging the retaining nut member 60 to a bottom section 34 of the main bolt member 26. This engagement may be accomplished by fastening an external threaded fastener 36' integrated on the main bolt member 26 to an internal threaded fastener 38' integrated on the retaining nut member 60. However, it is understood that the retaining nut member 60 may be attached to the main bolt member 26 by utilizing a variety of other suitable fasteners.

The retaining nut member 60 preferably has a hole 22 integrated therein adjacent to the bore 20. The hole 22 preferably is sized smaller than the bore 20 for the purpose of retaining a portion of the rod 24 within the bore 20. In particular, the rod 24 has a flange 40 extending therefrom that is sized slightly smaller than the bore 20 and larger than the hole 22. In this regard, the flange 40 is free to travel back and forth between the top section 62 of the shaft portion 32 and the retaining nut member 60.

Referring now to FIGS. 3A through 3C, there is shown yet another alternative embodiment of the present invention. In accordance with this embodiment, a piano string coil lifting and setting apparatus 10 includes an external slide hammer portion 58 and a string engaging portion 14 extending from the external slide hammer portion 58.

As best shown in FIGS. 3B and 3C, the external slide hammer portion 58 may include a main bolt member 26 with a bore 20 formed therethrough and a rod 24 that is reciprocal within the bore 20. In particular, the main bolt member 26 includes a head portion 30 and a shaft portion 32, with the bore 20 extending across the entire length of both portions 30, 32.

Furthermore, the rod 24 may be a bolt with a cap portion 64 integrated on one end and a detent nut member 66 attached to an opposing end. As shown in FIG. 3B, the cap portion 64 is intended to contact the head portion 30 of the main bolt member 26 so as to apply an upward force to the piano string coil 16. Likewise, as shown in FIG. 3C, the detent nut member 66 is intended to contact a bottom section 34 of the main bolt member 26 for the purpose of applying a downward force to the coil 16.

Figure 4:
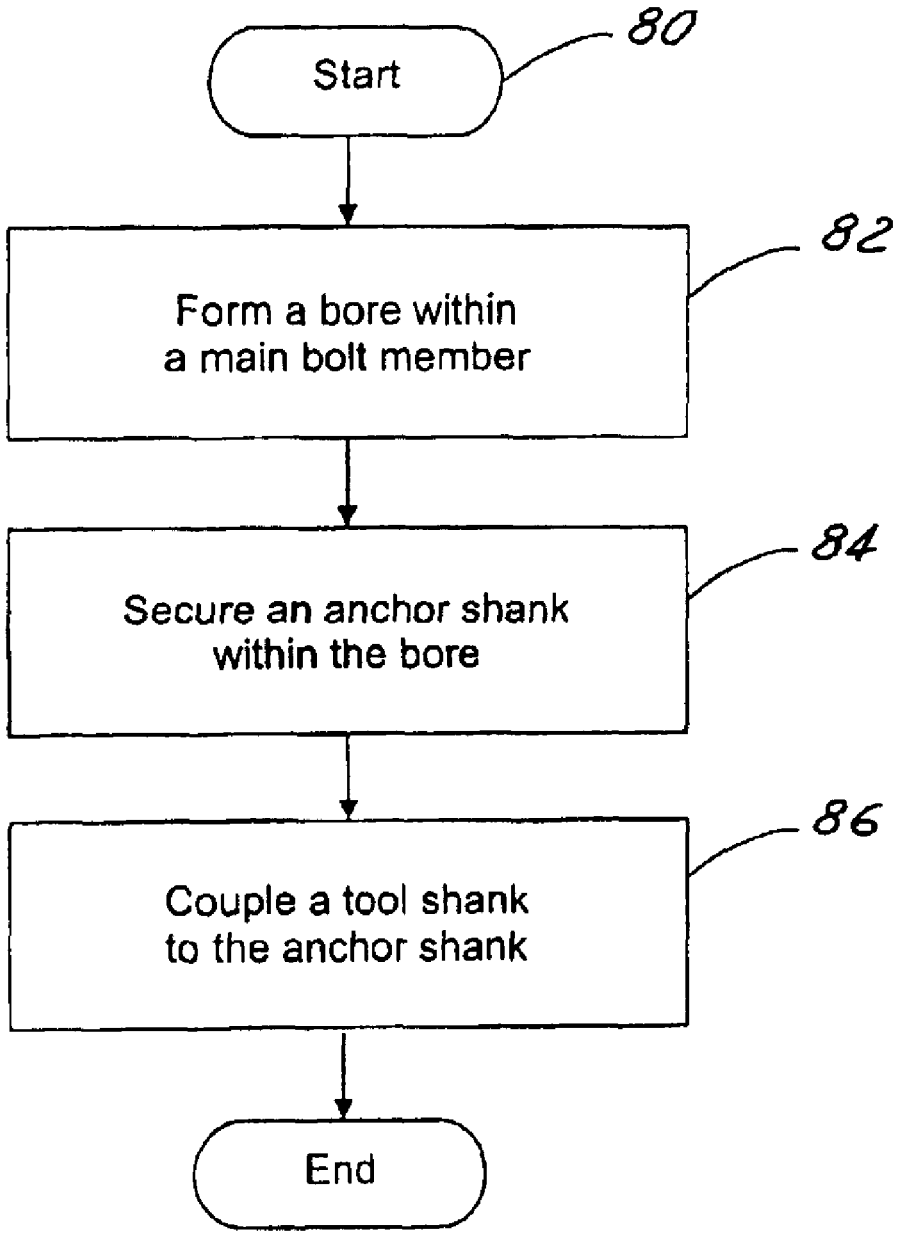
FIG. 4 is a flowchart depicting a method for manufacturing a piano string coil lifting and setting apparatus, in accordance with a preferred embodiment of the present invention.

Referring now to FIG. 4, there is shown a flowchart depicting a method for manufacturing a piano string coil lifting and setting apparatus 10, in accordance with a preferred embodiment of the present invention. The method commences at step 80 and immediately proceeds to step 82.

In step 82, a bore 20 is formed substantially across a longitudinal axis of a main bolt member 26. The bore 20 is preferably formed through a head portion 30 of the main bolt member 26 and across a substantial length of a shaft portion 32 of the main bolt member 26. Moreover, opposing ends of the bore 20 are preferably defined by a retaining bolt member 28 and a bottom section 34 of the shaft portion 32. As described above, the retaining bolt member 28 preferably is attached to the head portion 30 of the main bolt member 26. However, one skilled in the art would understand that various other structures with bores 20 integrally formed therein may be constructed. Then, the sequence proceeds to step 84.

In step 84, an anchor shank 42 is secured within the bore 20. In particular, the anchor shank 42 preferably is inserted into an open end of the bore 20 through the head portion 30. Thereafter, a retaining bolt member 28 preferably is threadably fastened or otherwise connected to the head portion 30 of the main bolt member 26. However, one skilled in the art will understand that a variety of other structures may be employed to accomplish this step as desired. Then, the sequence proceeds to step 86.

In step 86, a tool shank 44 is coupled to the anchor shank 42. Preferably, the anchor shank 42 has an internal threaded fastener 38 integrated therein for attaching to an external threaded fastener 36 integrated on the tool shank 44. Of course, however, the tool shank may be connected to the anchor shank by a variety of other different suitable fastening methods.

While particular embodiments of the invention have been shown and described, numerous variations and alternative embodiments will occur to those skilled in the art. Accordingly, it is intended that the invention be limited only in terms of the appended claims.

What is claimed is:

1. A piano string coil lifting and setting apparatus comprising:

a slide hammer portion; and a string engaging portion extending from said slide hammer portion, said string engaging portion intended to engage a piano string coil wrapped around a tuning pin and transmitting a force from said slide hammer portion to said piano string coil for purposes of adjusting the tension of said piano string coil.

2. The apparatus of claim 1 wherein said slide hammer portion comprises:

a housing defining a bore extending substantially across a longitudinal axis of said housing, said housing including an upward housing detent and a downward housing detent; and a rod intended to reciprocate within said bore of said housing, said rod including an upward rod detent for contacting said upward housing detent and applying an upward force to said piano string coil, said rod further including a downward rod detent for contacting said downward housing detent and applying a downward force on said piano string coil, said rod further having said string engaging portion extending therefrom.

3. The apparatus of claim 2 wherein said bore is sized larger than said upward rod detent and said downward rod detent so as to allow said upward rod detent and said downward rod detent to reciprocate within said bore.

4. The apparatus of claim 3 wherein said housing comprises:

a main bolt member having a head portion and a shaft portion extending from said head portion, said head portion and a substantial length of said shaft portion defining said bore, said bore terminating at a bottom section of said shaft portion, said bottom section having a hole integrally formed therein for allowing said rod to pass therethrough, said bottom section comprising said upper housing detent for contacting said upward rod detent and applying said upward force to said piano string coil; and a retaining bolt member intended to engage said head portion of said main bolt member within said bore, said retaining bolt member comprising said downward housing detent for contacting said downward rod detent and applying a downward force to said piano string coil.

5. The apparatus of claim 4 wherein said shaft portion includes at least one weight member coupled thereto for increasing the mass of said slide hammer portion.

6. The apparatus of claim 2 wherein said rod further comprises:

an anchor shank having a first fastener; and a tool shank having a second fastener for engaging said first fastener of said anchor shank, said tool shank having said string engaging portion extending therefrom.

7. The apparatus of claim 6 wherein said at least one intermediate fastener is employed for connecting said first fastener to said second fastener.

8. The apparatus of claim 6 wherein said string engaging portion extends from said rod into a plane that is approximately perpendicular to a longitudinal axis of said bore.

9. The apparatus of claim 3 wherein said housing comprises:

a main bolt member having a head portion and a shaft portion extending from said head portion, a substantial length of said shaft portion defining said bore, said bore terminating at a top portion of said shaft portion, said top portion comprising said downward housing detent for contacting said downward rod detent and applying said downward force to said piano string coil; and a retaining nut member intended to engage said bottom section of said shaft portion so as to cover said bore, said retaining nut member having a hole integrally formed therein for allowing said rod to pass therethrough, said retaining nut member comprising said upward housing detent for contacting said upward rod detent and applying an upward force to said piano string coil.

10. The apparatus of claim 9 wherein said shaft portion includes at least one weight member coupled thereto for increasing the mass of said slide hammer portion.

11. The apparatus of claim 1 wherein string engaging portion comprises at least two prongs extending from said rod.

12. A piano string coil lifting and setting apparatus comprising:

a main bolt member having a head portion and a shaft portion extending from said head portion, said main bolt member defining a bore across a longitudinal axis of said main bolt member, said shaft portion having a bottom section comprising a downward bolt detent, said head portion comprising an upward bolt detent;

a rod intended to reciprocate through said bore, said rod including a upward rod detent for contacting said upward bolt detent and applying an upward force to a piano string coil that is wrapped around a tuning pin, said rod further including a downward rod detent for contacting said downward bolt detent and applying a downward force to said piano string coil, said upward rod detent and said downward rod detent being sized larger than said bore and situated on opposing sides of said bore; and a string engaging portion extending from said rod, said string engaging portion for engaging said piano string coil and transmitting at least one of said upward force and said downward force to said piano string coil.

13. The apparatus of claim 12 wherein said main bolt member includes at least one weight member coupled thereto for increasing said upward force and said downward force applied to said piano string coil.

14. The apparatus of claim 12 wherein said rod further comprises:

an anchor shank having a first fastener; and a tool shank having a second fastener for engaging said first fastener of said anchor shank, said tool shank having said string engaging portion extending therefrom.

15. The apparatus of claim 14 wherein said at least one intermediate fastener is employed for connecting said first fastener to said second fastener.

16. The apparatus of claim 14 wherein said first fastener and said second fastener are an internal threaded fastener and an external threaded fastener, respectively.

17. The apparatus of claim 12 wherein said string engaging portion extends from said rod into a plane that is approximately perpendicular to a longitudinal axis of said main bolt member.

18. A method for manufacturing a piano string coil lifting and setting apparatus comprising:

forming a bore substantially across a longitudinal axis of a main bolt member, said main bolt member having a head portion and a shaft portion extending from said head portion;

disposing an anchor shank within said bore of said main bolt member;

securing said anchor shank within said bore of said main bolt member; and coupling a tool shank to said anchor shank, said tool shank having a string engaging portion extending therefrom.

19. The method of claim 18 wherein said securing said anchor shank within said bore comprises at least one of:

fastening a retaining bolt member to said head portion of said main bolt member and within said bore of said main bolt member;

fastening a graduated retaining nut member to a bottom section of said shaft portion of said main bolt member; and fastening a conventional retaining nut member to an end portion of said anchor shank and a mating end portion of said tool shank.

20. The method of claim 18 where said coupling said tool shank to said anchor shank comprises at least one of:

fastening a pair of opposing threaded fasteners respectively integrated within said anchor shank and said tool shank;

fastening at least one secondary nut member on said end portion of said anchor shank adjacent to said conventional retaining nut member; and fastening said at least one secondary nut member on said mating end portion of said tool shank adjacent to said conventional retaining nut member.

* * * * *